US008613240B2

(12) United States Patent
Feraud et al.

(10) Patent No.: US 8,613,240 B2
(45) Date of Patent: Dec. 24, 2013

(54) IMPROVER ONE-PIECE MANUAL TIGHTENING TOOL FOR DRIVING A FASTENER

(75) Inventors: Norbert Pierre-Henri Feraud, Versailles (FR); Philippe Michel Christian Praudel, Longjumeau (FR); Stéphane Thirouin, Paris (FR); Benoit Tillet, Paris (FR)

(73) Assignee: Stanley Works (Europe), GmbH (CH)

( * ) Notice: Subject to any disclaimer, the term of this patent is extended or adjusted under 35 U.S.C. 154(b) by 689 days.

(21) Appl. No.: 12/676,241

(22) PCT Filed: Aug. 12, 2008

(86) PCT No.: PCT/FR2008/051490

§ 371 (c)(1),
(2), (4) Date: May 11, 2010

(87) PCT Pub. No.: WO2009/030852

PCT Pub. Date: Mar. 12, 2009

(65) Prior Publication Data

US 2010/0269642 A1 Oct. 28, 2010

(30) Foreign Application Priority Data

Sep. 3, 2007 (FR) ..... 07 57325

(51) Int. Cl.

| | |
|---|---|
| ***B25B 13/02*** | (2006.01) |
| ***B25B 13/00*** | (2006.01) |
| ***B25B 17/00*** | (2006.01) |
| ***B25B 13/28*** | (2006.01) |

(52) U.S. Cl.
USPC ..... 81/119; 81/57.34; 81/57.36; 81/58.1; 81/77; 81/91.3; 81/125.1

(58) Field of Classification Search
USPC ..... 81/119, 125.1, 57.34, 57.36, 58.1, 77, 81/91.3, 121.1
See application file for complete search history.

(56) References Cited

U.S. PATENT DOCUMENTS

| | | | | |
|---|---|---|---|---|
| 1,764,990 | A | 6/1930 | Schultz | |
| D484,014 | S * | 12/2003 | Chen | D8/28 |
| 2004/0255724 | A1 | 12/2004 | Lin | |

FOREIGN PATENT DOCUMENTS

| | | |
|---|---|---|
| DE | 85 12 006 | 6/1985 |
| DE | 200 21 160 | 3/2001 |

(Continued)

OTHER PUBLICATIONS

International Search Report dated Feb. 2, 2009, from corresponding PCT application.

*Primary Examiner* — Monica Carter
*Assistant Examiner* — Danny Hong
(74) *Attorney, Agent, or Firm* — Richard J. Veltman; John D. DelPonti

(57) ABSTRACT

This tool substantially extends in a general plane (XY) and comprises: —at least one working head (12, 13) intended to cooperate with the fastener; —a handle (14) which is integral with the or each working head; the handle extending along a longitudinal axis (X-X) and comprising a linear portion (15) and at least one connection portion (16, 17) which connects the or each working head to the linear portion, the linear portion of the handle having a section transverse to the longitudinal axis (X-X) which comprises a relatively large transverse dimension substantially parallel with the general plane of the tool (XY) perpendicular to the longitudinal axis (X-X), and a relatively small dimension perpendicular to the general plane of the tool (XY). The large dimension and the small dimension of the transverse section are changing along the longitudinal axis. Use in flat wrenches, combination wrenches and ring wrenches.

11 Claims, 3 Drawing Sheets

(56) References Cited

FOREIGN PATENT DOCUMENTS

| | | |
|---|---|---|
| DE | 102 32 121 | 2/2004 |
| DE | 20 2006 011 182 | 9/2006 |
| FR | 623 208 | 6/1927 |
| FR | 2 838 664 | 10/2003 |
| WO | 99/06184 | 2/1999 |

* cited by examiner

IMPROVER ONE-PIECE MANUAL TIGHTENING TOOL FOR DRIVING A FASTENER

The present invention relates to a one-piece manual tightening tool for driving a fastener, the tool substantially extending in a general plane.

SUMMARY OF THE INVENTION

The invention particularly applies to flat wrenches, combination wrenches and ring wrenches and, hereinafter, reference will be made to those applications.

Under conditions of use in a cramped environment, such as a motor vehicle engine, those known wrenches have poor characteristics in terms of the compactness of the handle which do not facilitate use of the tool. The operations for re-working the fastener are long and repetitive.

An object of the invention is to overcome those disadvantages for using the wrench in a particularly ergonomic manner, whilst ensuring the robustness of the wrench.

To that end, the invention relates to a one-piece manual tightening tool of the above-mentioned type, characterised in that the large dimension and the small dimension of the transverse section are changing along the longitudinal axis.

Other features of the monobloc manual securing tool according to the invention, which can be taken individually or in accordance with any technically possible combination, are described in the description that follows.

BRIEF DESCRIPTION OF THE DRAWINGS

The invention and its advantages will be better understood from a reading of the following description which is given purely by way of example and with reference to the appended drawings, in which.

DETAILED DESCRIPTION OF THE PREFERRED EMBODIMENTS

Figure 1:
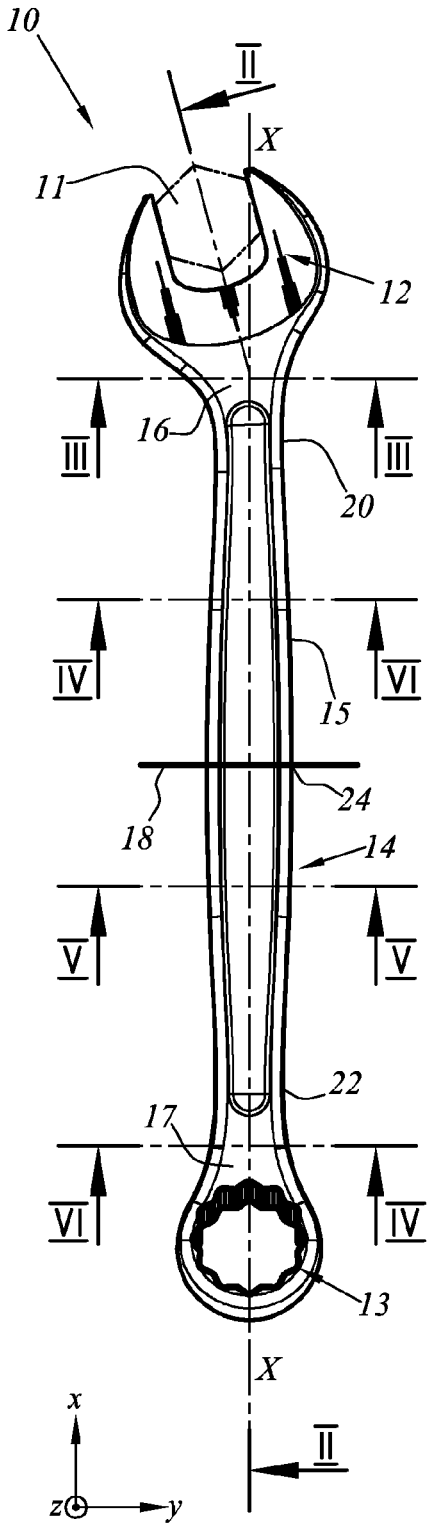
FIG. 1 is a front view of the tool according to the invention.

In order to describe the one-piece manual tightening tool according to the invention in a more convenient manner, it will be assumed to be orientated as illustrated in the drawings, that is to say, extending along a longitudinal axis X-X, a transverse axis Y, which define the general plane XY of the tool, and along a third axis Z defining the thickness of the tool.

The one-piece manual tightening tool 10 illustrated in FIGS. 1 to 6 is intended mainly to screw and unscrew a fastener or fixing element 11 which is generally of hexagonal shape, particularly a bolt or a nut.

In FIG. 1, the tool 10 is a metal combination wrench, particularly composed of steel. It comprises two working heads 12 and 13 having the same opening, one being of fork-like form 12 and the other of eyelet-like form 13, in the example illustrated with an eyelet having a closed profile, which are arranged at the ends of a handle 14. The handle 14, which is integral with the working heads 12 and 13, substantially extends along the longitudinal axis X-X. It comprises a linear portion 15 which is connected to the fork 12 and the eyelet 13 by means of connection portions 16 and 17, respectively.

The handle 14 has a transverse section which is perpendicular to the longitudinal axis X-X and which comprises a relatively large transverse dimension A which is substantially parallel with the general plane of the tool XY and which is perpendicular to the longitudinal axis X-X, and a relatively small dimension B which is perpendicular to the general plane of the tool XY. The transverse section of the handle 14 is developed in accordance with the large dimension A and the small dimension B in accordance with the position of the section along the longitudinal axis X-X.

The linear portion 15 of the handle 14 has a transverse section whose large dimension progressively increases from the connection portions 16 and 17 substantially as far as the median plane 18 of the linear portion in accordance with the longitudinal axis X-X.

The connection portions 16 and 17 are tangentially connected to the portion 15 and have a transverse section whose large dimension progressively increases in accordance with the longitudinal axis X-X from the linear portion 15 of the handle 14 as far as their tangential connection with respect to the corresponding working heads 12 and 13.

In this manner, the connection between the or each connection portion 16 and 17 and the linear portion 15 of the handle 14 corresponds to a maximum narrowing 20 and 22 of the large dimension of the transverse section, respectively. Those neck-like shapes of minimum width allow the user to carry out an angular manoeuvre of the wrench about the axis of the fixing element under more favourable conditions in terms of an angular range than those under which an operator uses a conventional wrench having a straight handle of constant width.

The linear portion 15 of the handle 14 further comprises at least one maximum widening 24 of the large dimension of the transverse section. That shape of maximum width is located substantially in the median plane 18 of the linear portion 15. The ratio between the maximum widening/maximum narrowing of the combination wrench 10 is greater than 1 and less than or equal to 1.8.

Figure 2:
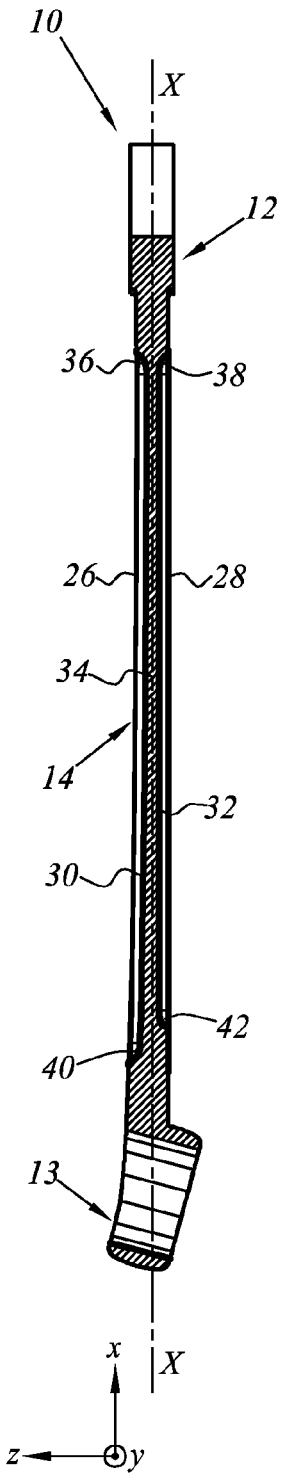
FIG. 2 is a longitudinal section through the tool along the line II-II of FIG. 1.
Figure 3:
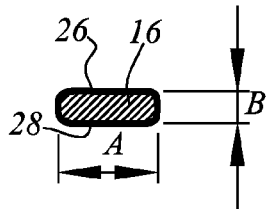
FIGS. 3 to 6 are cross-sections of the tool along the lines III-III to VI-VI of FIG. 1, respectively.
Figure 4:
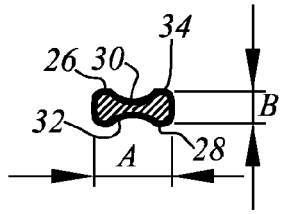
Figure 5:
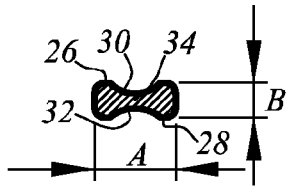
Figure 6:
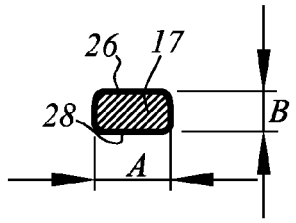
Figure 7:
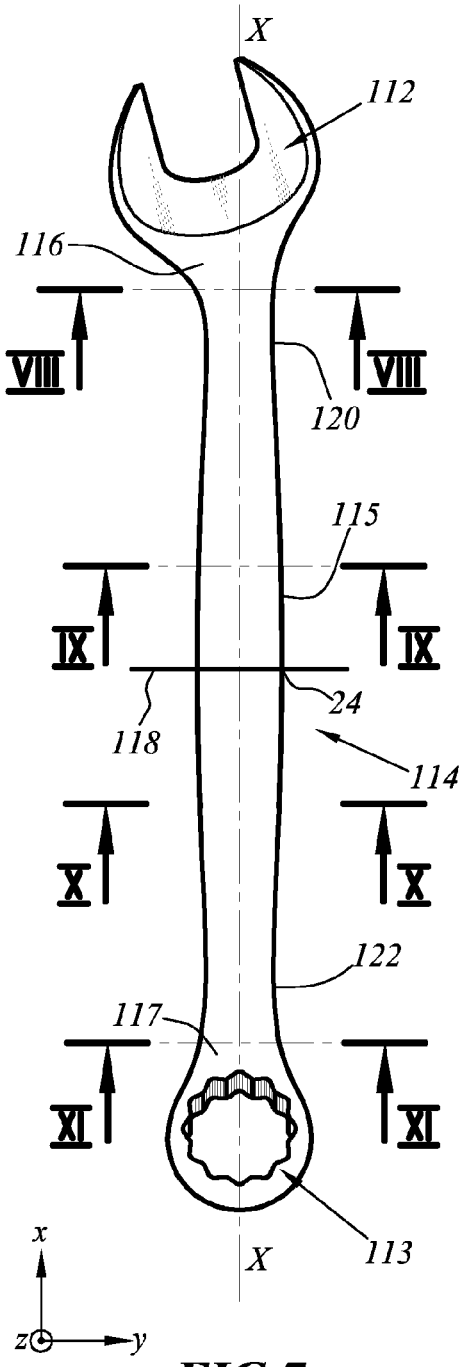
FIG. 7 is a front view similar to FIG. 1, showing a first variant of the tool according to the invention.
Figure 8:
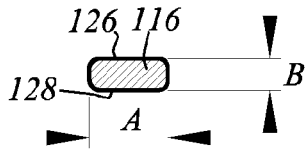
FIGS. 8 to 11 are cross-sections of the tool along the lines VIII-VIII to XI-XI of FIG. 7, respectively.
Figure 9:
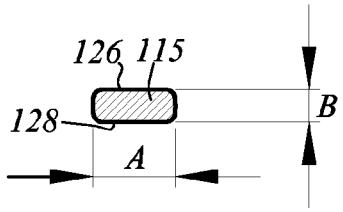
Figure 10:
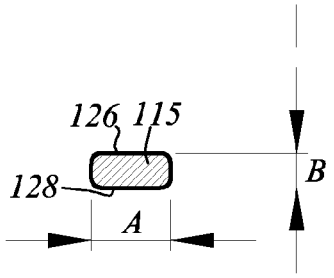
Figure 11:
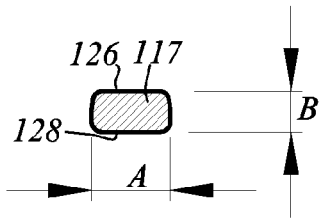

In FIG. 2, the small dimension of the handle 14, that is to say, the dimension along the axis Z-Z, increases progressively from the fork-like working head 12 as far as the eyelet-like working head 13 along the longitudinal axis X-X.

The handle 14 comprises two external faces 26 and 28 which comprise the large dimension A and which are substantially planar and substantially parallel with the general plane XY of the wrench. Each external face 26 and 28 has a longitudinal recess 30 and 32, respectively. A wall or web 34 separates the bottom of the recesses 30 and 32. The linear portion of the handle thereby generally has an H-shaped transverse section.

The or each longitudinal recess 30 and 32 extends in the or each connection portion 16 and 17 of the handle slightly beyond the corresponding maximum narrowings 20 and 22.

In the case of the combination wrench, the recesses 30 and 32 comprise ends 36 and 38 which are substantially opposite each other at the side of the fork-like working head 12 and ends 40 and 42 which are longitudinally displaced at the side of the eyelet-like working head 13. This prevents the forged tooling from becoming embrittled in the region of connection of the eyelet.

As illustrated in FIGS. 3 to 6, the transverse section of the handle 14 is changing or evolutive from one working head to the other along the axis X-X, both in terms of the shape and in terms of dimensions. The large dimension A in accordance with the transverse axis Y-Y and the small dimension B in accordance with the axis Z-Z vary in accordance with the position of the section in accordance with the axis X-X. The ratio between the maximum thickness/minimum thickness is between 1.1 and 1.5.

The evolution of the thickness of the combination wrench 10 follows the curvature of a polynomial curve whose minimum in terms of thickness is substantially eccentric relative to the median plane 18.

The linear portion of the handle of the wrench is configured in such a manner that the thickness of the handle in the zones of contact with the hand is increased in comparison with a conventional wrench and the edges are not provided with sharp angles. In this manner, pressure on the zones of contact with the hand of the user, in particular the thumb and the palm, is reduced which makes the tool ergonomic both during the engagement operation and during the securing operation.

Furthermore, the mechanical strength of the wrench is not affected by the optimised distribution of material in the various transverse sections of the handle.

FIGS. 7 to 11 illustrate a first variant of the tool according to the invention, in which the wrench portions similar to those of the tool illustrated in FIGS. 1 to 6 bear the same reference numerals increased by 100.

The combination wrench 110 differs from the wrench described previously in that it is not provided with longitudinal recesses which are arranged at the external faces 126 and 128 comprising the large dimension A. In this manner, the various transverse sections are generally of rectangular shape, whose large dimension A and small dimension B vary in accordance with the position of the section along the longitudinal axis X-X.

Figures 12, 13, 14, 15:
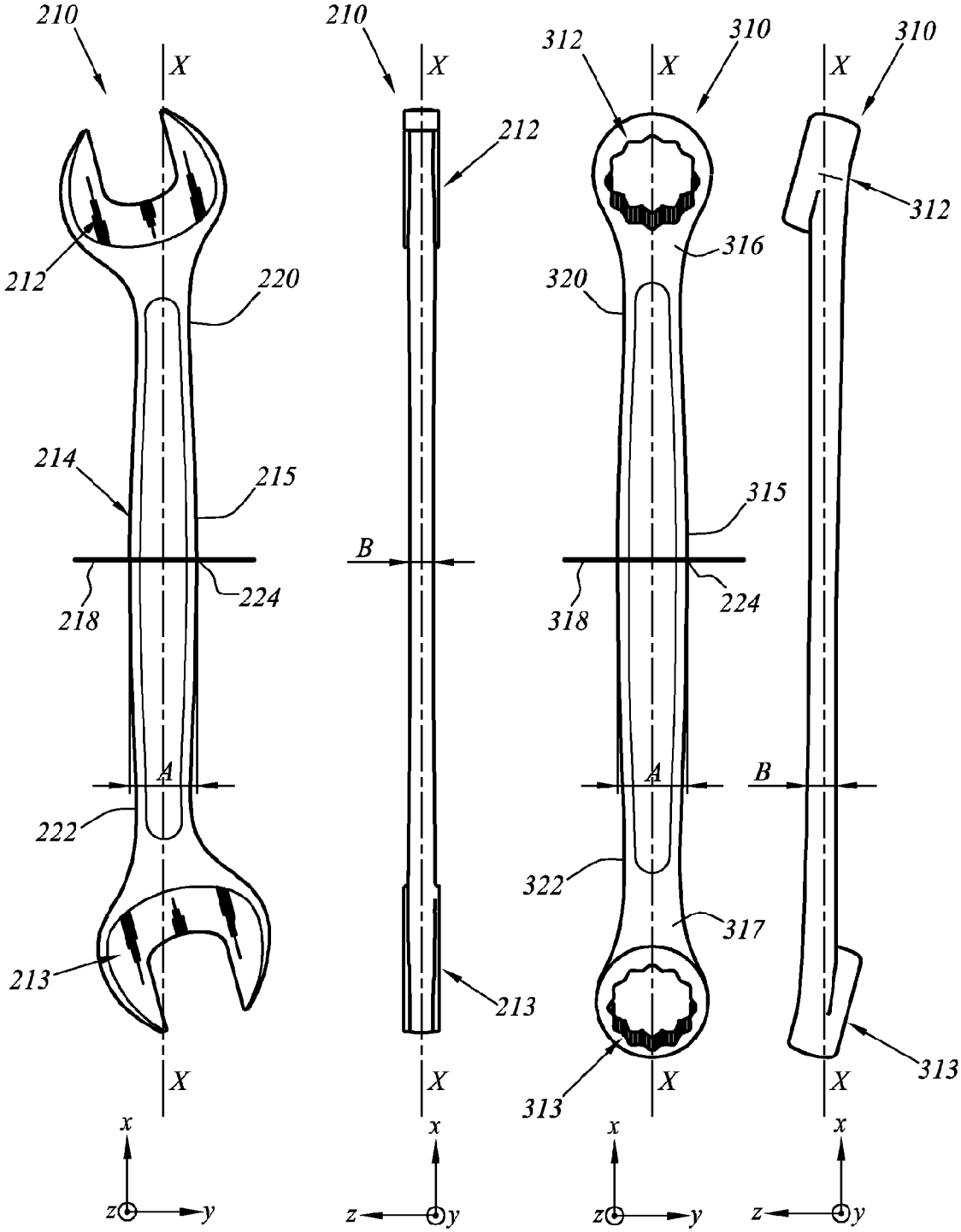
FIG. 12 is a view similar to FIG. 1, showing a second variant of the tool according to the invention.
FIG. 13 is a side view of the tool illustrated in FIG. 12.
FIG. 14 is a view similar to FIG. 1, showing a third variant of the tool according to the invention.
FIG. 15 is a side view of the tool illustrated in FIG. 14.

FIGS. 12 and 13 illustrate a second variant of the tool according to the invention, in which the wrench portions similar to those of the tool illustrated in FIGS. 1 to 6 bear the same reference numerals increased by 200.

The flat wrench 210 differs from the combination wrench 10 previously described with reference to FIGS. 1 to 6 in that it comprises two working heads of the fork-like type having different openings. The large dimension A of the transverse section of the handle varies in a manner similar to that described in the context of the preceding combination wrench 10. The small dimension B of the transverse section of the handle progressively increases, along the longitudinal axis X-X, from the connection portions 220 and 222 substantially as far as the median plane 218 of the linear portion of the handle 214. The small dimension B reaches a minimum substantially in the median plane 218.

The ratio between the maximum widening/maximum narrowing of the flat wrench 210 is greater than 1 and less than or equal to 1.8. The ratio between the maximum thickness/minimum thickness is between 1.1 and 1.2.

The FIGS. 14 to 15 illustrate a third variant of the tool according to the invention and the wrench parts similar to those of the tool illustrated in FIGS. 1 to 6 bear the same reference numerals increased by 300 therein.

The offset wrench 310 differs from the combination wrench 10 described previously with reference to FIGS. 1 to 6 in that it comprises two working heads of the eyelet-like type having different openings. The large dimension A of the transverse section of the handle varies in a manner similar to that described in the context of the preceding combination wrench 10. The small dimension B of the transverse section of the handle progressively decreases, along the longitudinal axis X-X, from the connection portions 220 and 222 substantially as far as the median plane 218 of the linear portion of the handle 214. The small dimension B reaches a minimum substantially in the median plane 218.

The ratio between the maximum widening/maximum narrowing of the offset wrench 310 is greater than 1 and less than or equal to 1.8. The ratio between the maximum thickness/minimum thickness is between 1.15 and 1.25.

The evolution of the thickness of the flat wrench 210 and the offset wrench 310 follows the curvature of a polynomial curve whose minimum in terms of thickness is substantially centred on the corresponding median planes 218 and 318 of each of the wrenches 210 and 310.

Owing to the invention, the one-piece manual tightening tool is easier to use in confined spaces. The wrench further retains good characteristics in terms of mechanical strength and is particularly ergonomic.

The invention claimed is:

1. A one-piece manual tightening tool for driving a fastener, the tool substantially extending in a general plane and comprising:

two working heads which are intended to cooperate with the fastener, said working heads comprising a fork working head and an eyelet working head; and a handle which is integral with the two working heads, the handle extending along a longitudinal axis and comprising a linear portion and respective connection portions which connect each working head to the linear portion, the linear portion of the handle having a transverse section which is transverse relative to the longitudinal axis and which comprises a first transverse dimension substantially parallel with the general plane of the tool and which is perpendicular to the longitudinal axis, and a second dimension which is smaller than the first dimension and is perpendicular to the general plane of the tool, wherein the first dimension and the second dimension of the transverse section change along the longitudinal axis, and wherein the second dimension of the transverse section of the handle increases from the fork working head as far as the eyelet working head between a minimum and a maximum, a ratio of the maximum of the second dimension to the minimum of the second dimension being between 1.1 and 1.5.

2. The securing tool according to claim 1, wherein respective connections between each connection portion and the linear portion of the handle each correspond to a maximum narrowing of the first dimension of the transverse section.

3. The securing tool according to claim 1, wherein the linear portion of the handle comprises a maximum widening of the first dimension of the transverse section.

4. The securing tool according to claim 3, wherein the maximum widening of the linear portion of the handle is located substantially in a median plane of the linear portion along the longitudinal axis.

5. The securing tool according to claim 1, wherein the handle comprises two external faces, at least one of the two external faces having provided therein a recess which extends, in the linear portion of the handle, along the longitudinal axis.

6. The securing tool according to claim 1, wherein the handle comprises two external faces, and the external faces of the handle each comprise a recess extending in the linear portion of the handle along the longitudinal axis, the linear portion of the handle having an H-shaped transverse section.

7. The securing tool according to claim 2, wherein the handle comprises two external faces, at least one of the two external faces having provided therein a recess which extends, in the linear portion of the handle, along the longitudinal axis, and wherein the recess of the at least one of the two external faces extends in at least one of the connection portions of the handle beyond the maximum narrowing.

8. The securing tool according to claim 6, wherein the recesses of the two external faces comprise first ends which are substantially opposite each other at a side of the fork working head, and comprise ends which are longitudinally displaced relative to each other at a side of the eyelet working head.

9. The securing tool according to claim 1, wherein the first dimension has a maximum widening, and a ratio of the maximum widening to a maximum narrowing of the first dimension is greater than 1 and less than or equal to 1.8.

10. The securing tool according to claim 1, wherein said eyelet has a closed profile.

11. A one-piece manual tightening tool for driving a fastener, the tool substantially extending in a general plane and comprising:

two working heads which are intended to cooperate with the fastener, said working heads comprising a fork working head and an eyelet working head;

a handle which is integral with the two working heads, the handle extending along a longitudinal axis and comprising a linear portion and respective connection portions which connect each working head to the linear portion, the linear portion of the handle having a transverse section which is transverse relative to the longitudinal axis and which comprises a first transverse dimension which is substantially parallel with a general plane of the tool and which is perpendicular to the longitudinal axis, and a second dimension which is smaller than the first dimension and is perpendicular to the general plane of the tool, wherein the first dimension and the second dimension of the transverse section change along the longitudinal axis, wherein the handle comprises two external faces, each of which having a recess which extends, in the linear portion of the handle, along the longitudinal axis, the transverse section of the linear portion of the handle having an H-shape, and wherein the recesses of the external faces comprise first ends which are substantially opposite each other at the side of the fork working head, and comprise second ends which are longitudinally displaced relative to each other at the side of the eyelet-like working head.

* * * * *